US005863222A

United States Patent [19]

Kinsey, Jr. et al.

[11] Patent Number: 5,863,222

[45] Date of Patent: Jan. 26, 1999

[54] SHIELDED ELECTRICAL CONNECTOR

[75] Inventors: Forrest Irving Kinsey, Jr., Harrisburg; John Raymond Shuey, Millersville; John Mark Myer, Mechanicsburg, all of Pa.

[73] Assignee: The Whitaker Corporation, Wilmington, Del.

[21] Appl. No.: 868,202

[22] Filed: Jun. 3, 1997

[51] Int. Cl.[6] ..... H01R 13/648

[52] U.S. Cl. ..... 439/607; 439/567; 439/939; 439/79

[58] Field of Search ..... 439/527, 533, 439/567, 569, 573, 607, 609, 939, 79

[56] References Cited

U.S. PATENT DOCUMENTS

| | | | |
|---|---|---|---|
| 4,215,910 | 8/1980 | Walter . | |
| 4,371,226 | 2/1983 | Brancaleone . | |
| 4,932,888 | 6/1990 | Senor | 439/108 |
| 5,161,999 | 11/1992 | Broschard, III et al. | 439/567 |
| 5,167,531 | 12/1992 | Broschard, III et al. | 439/540 |
| 5,304,069 | 4/1994 | Brunker et al. | 439/108 |
| 5,352,135 | 10/1994 | Lenoir | 439/607 |
| 5,376,021 | 12/1994 | Rodrighues et al. | 439/608 |

FOREIGN PATENT DOCUMENTS

| | | | |
|---|---|---|---|
| WO 96/21256 | 7/1996 | WIPO | H01R 9/09 |

OTHER PUBLICATIONS

Patents Act 1977, Search Report under Section 17, Application No.: GB 9713333.4, Date of Search: 13 Aug. 1997.

*Primary Examiner*—Khiem Nguyen
*Attorney, Agent, or Firm*—Bradley N. Ditty

[57] ABSTRACT

A shielded connector assembly (10) includes a header (20), a shield plate (30), and a pin guide (40). The shield plate (30) is formed of a metallic material and is mounted to header (20) by action of clips **(34*a*) which engage clip engaging surfaces (24*a*) of header (20). Pin guide (40) is mounted to header (20) by action of dovetailed sections (46) which are slidingly disposed in respective dovetailed recesses (26) formed in header (20)**.

5 Claims, 6 Drawing Sheets

SHIELDED ELECTRICAL CONNECTOR

The present invention relates to a shielded electrical connector assembly; more particularly, the present invention relates to a shielded connector having a pin guide mountable to the connector in a way that minimizes the size and production cost of the assembly.

BACKGROUND OF THE INVENTION

Shielded electrical connectors are used in the electronics industry for their ability to shield electrical circuits from the deleterious effects of ambient electrical or electromagnetic energy, i.e. EMI. A standard shield design provides a ground path whereby the electromagnetic energy is drained to ground and is thereby dissipated. Shielded connectors often include pin contacts as a means of electrically connecting the connector to, for example, a printed circuit board. For manufacturing reliability, the pins are protected and guided to specific soldering locations on the printed circuit board by a pin guide member. Assuming that the reliability of the finished shielded connector product is satisfactory, the cost of production of such electrical connectors is often the determining factor as to whether the product will be commercially successful. Therefore, in general, the combination of high reliability of the shielded connector with the low overall cost thereof is most advantageous.

A known shielded connector assembly is disclosed in U.S. Pat. No. 5,304,069, hereby incorporated by reference in its entirety, which assembly provides a shielded connector housing with a pin guide member. A board lock is integrally formed with the shield, and the pin guide member is mounted to the connector by gussets which extend from a rear face of the connector. The unitary shield/board lock construction is expensive to manufacture, and presents potential manufacturing and assembly difficulties as well. Moreover, largely due to the gusset structure, the known connector would disadvantageously use a copious amount of space in an electronics package.

SUMMARY OF THE INVENTION

To overcome these problems, the present invention provides an electrical connector assembly comprising: an electrical connector having at least one electrical contact therein; a conductive shield mounted to the connector, the shield comprises at least one shield solder tab; and a contact pin guide member mountable to the electrical connector. The pin guide member has an associated assembly direction of motion relative to the electrical connector, the pin guide comprises at least one contact receiving hole therethrough for guiding the electrical contact, and a shield solder tab receiving aperture for receiving the solder tab therethrough as the pin guide is mounted to the electrical connector. The foregoing pin guide arrangement broadly defines a connector which is advantageously of a low production cost.

The pin guide comprises a board lock section, and the electrical connector and the pin guide comprise complementary mounting structure, whereby the mounting structure comprises at least one slot for receiving a respective mounting projection. More particularly, the electrical connector and the pin guide comprise complementary mounting structure for assembling the pin guide to the electrical connector whereby the pin guide assembly direction of motion advantageously approaches the electrical connector from a bottom side thereof. Such an assembly motion allows the pin guide to include the board lock section, and to accommodate the shield solder tabs, thus the overall assembly is compact.

DETAILED DESCRIPTION OF THE INVENTION

Figure 1:
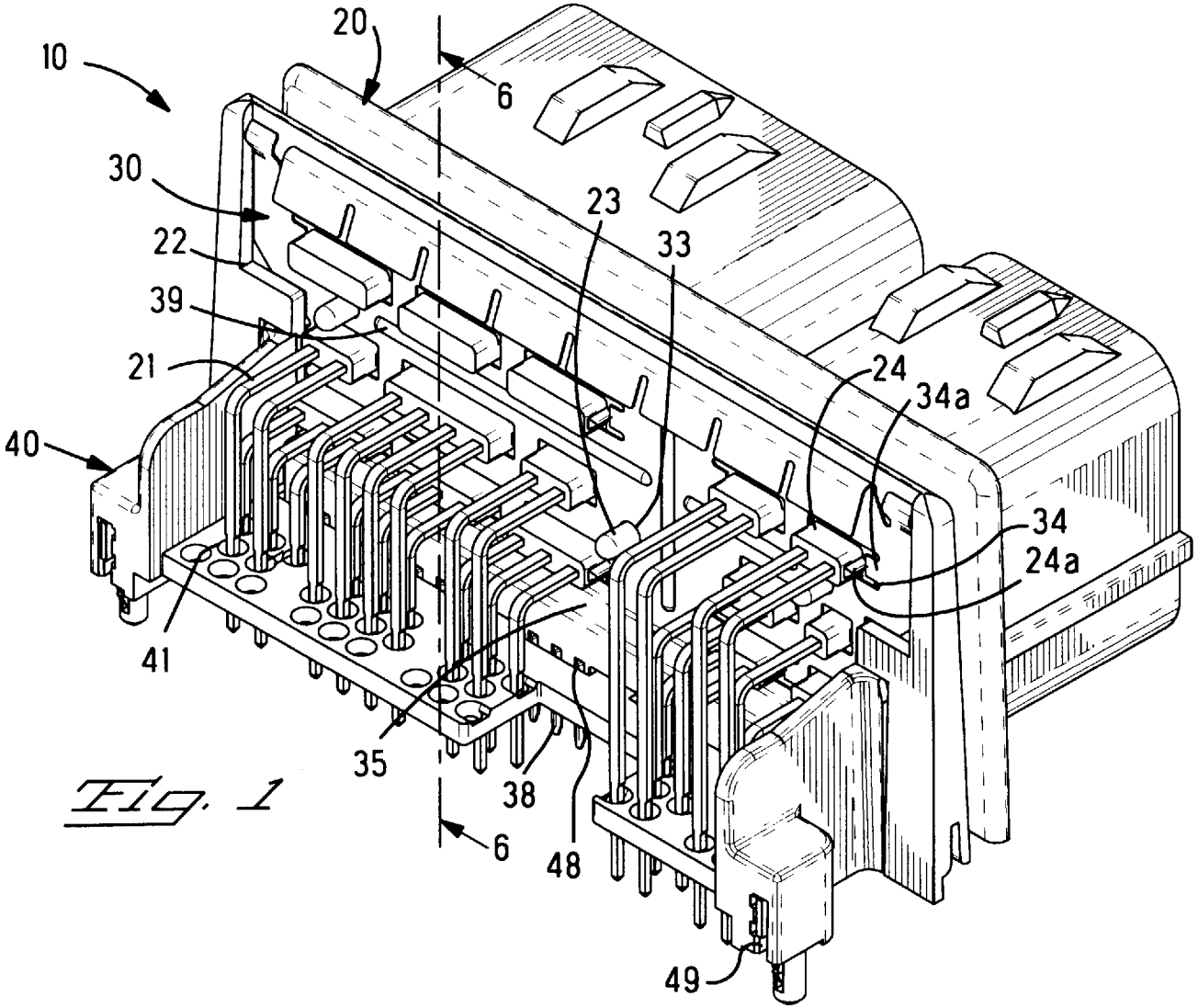
FIG. 1 is an isometric view of the shielded electrical connector assembly according to the present invention.
Figure 3:
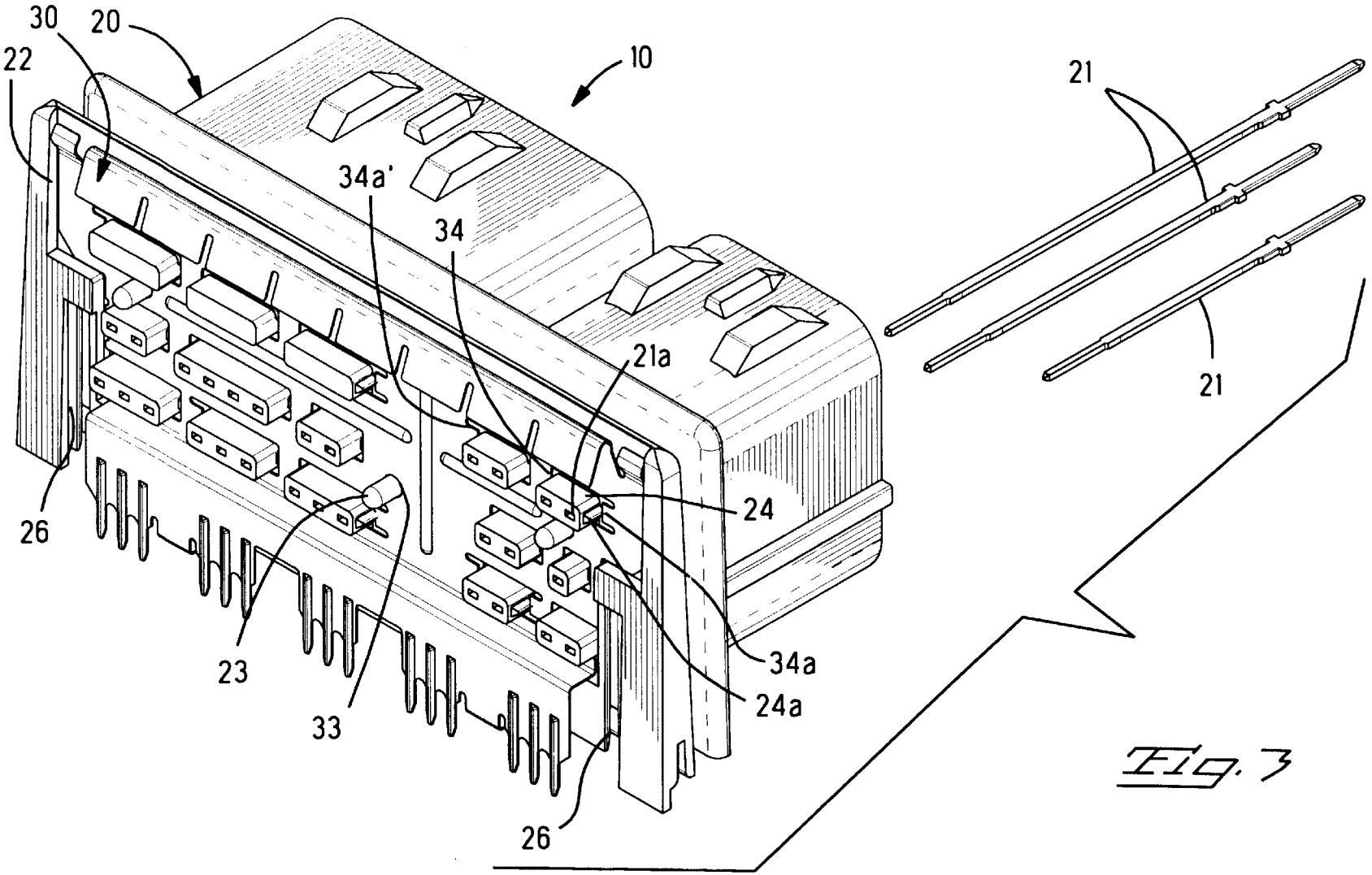
FIG. 3 is an isometric view of electrical contacts about to be stitched into the electrical connector of FIG. 1.
Figure 4:
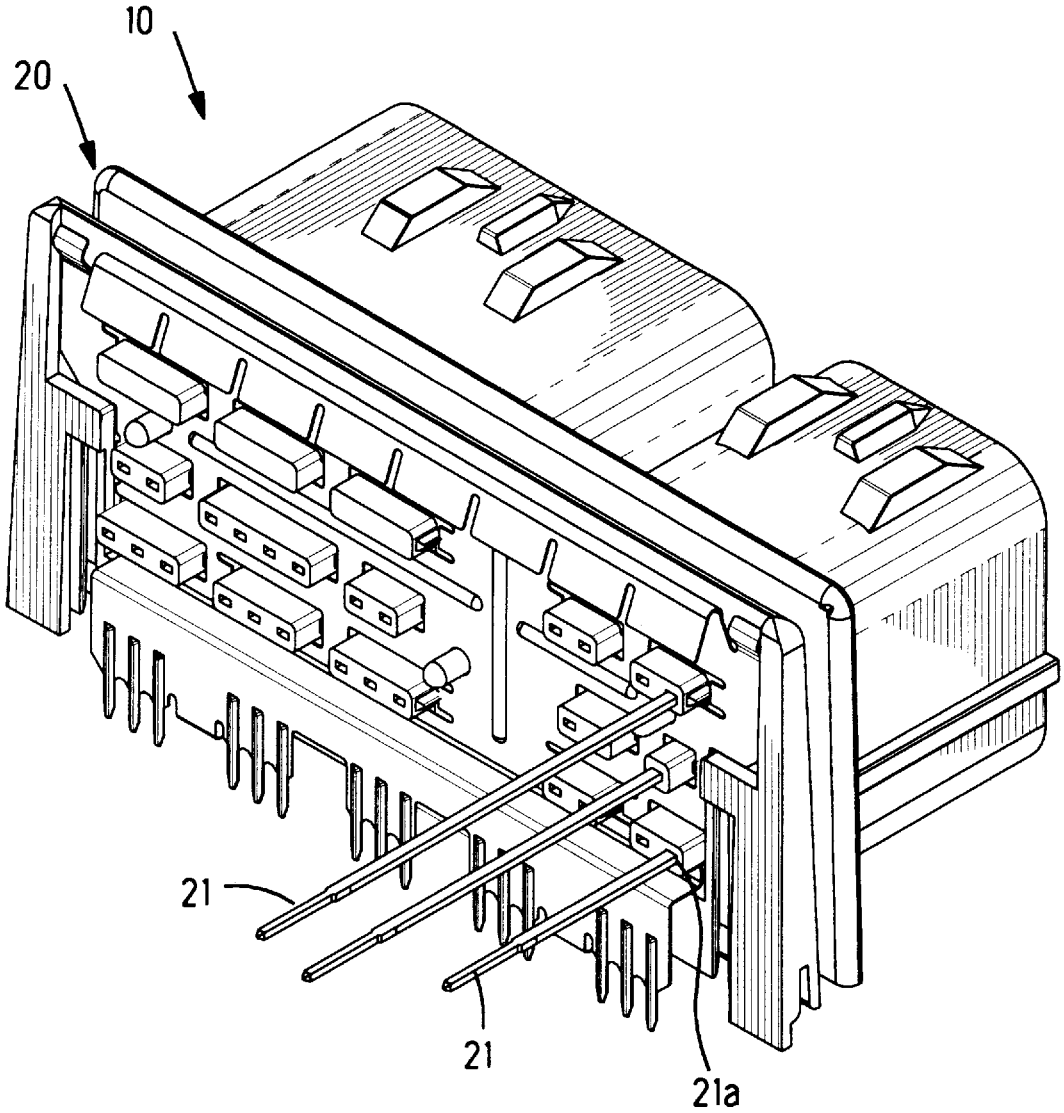
FIG. 4 is an isometric view of the contacts of FIG. 3 in the electrical connector but prior to being bent.
Figure 5:
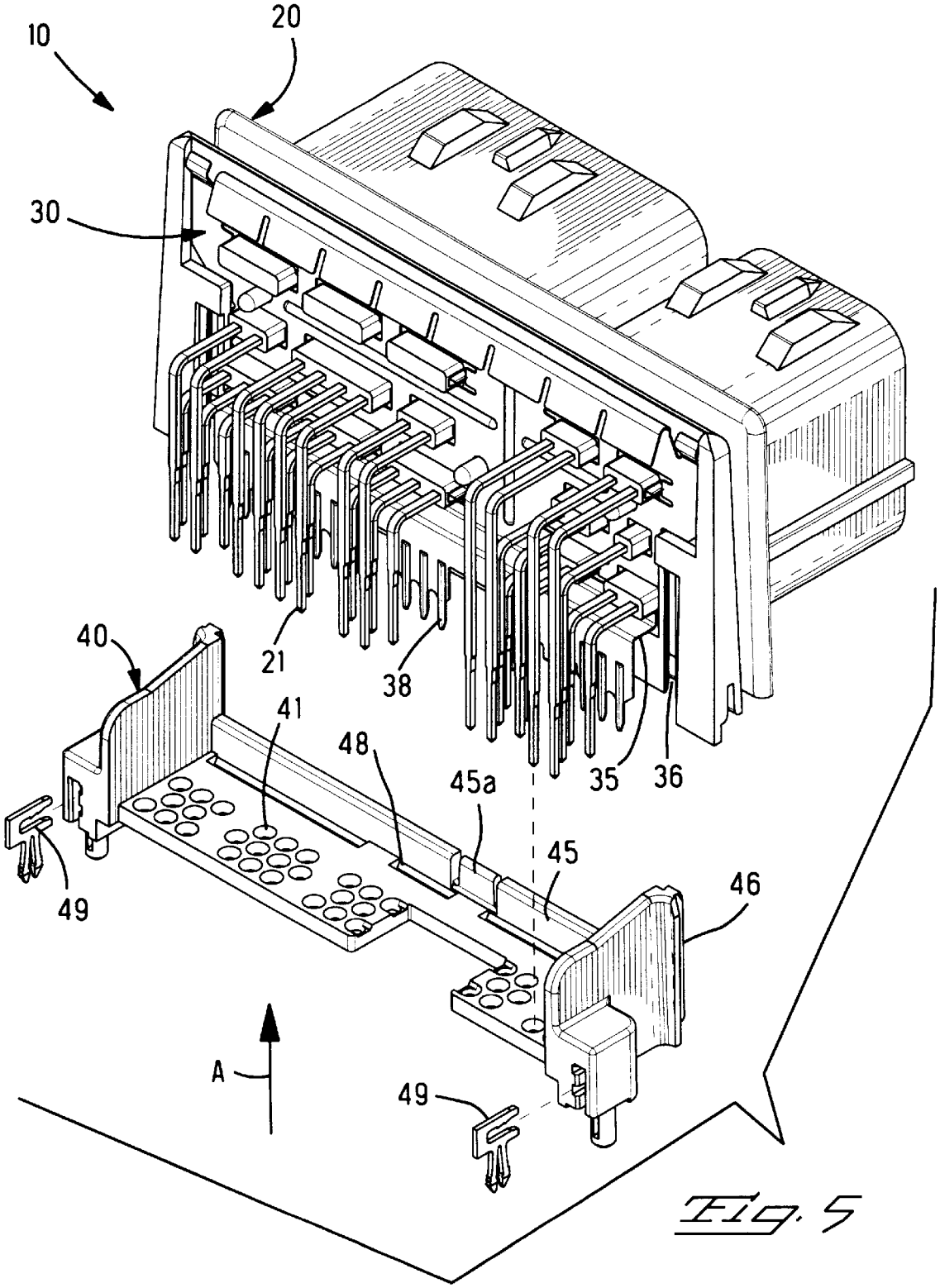
FIG. 5 is an isometric assembly view of a pin guide of the present invention exploded away from the electrical connector housing.

Referring to FIGS. 1, 3, and 5, the shielded connector assembly 10 according to the present invention will be described. Shielded connector assembly 10 includes a header 20, a shield plate or ground plane 30, and a pin guide 40. Header 20 includes: pin contacts 21 disposed in pin contact receiving apertures 21*a*, as is best shown in FIGS. 1 and 4; a recess 22 for receiving the shield plate 30 therein; guide posts 23 for registering with shield plate 30; contact pin bosses 24 having clip engaging surfaces 24*a* formed thereon; and a pair of dovetailed recesses 26 for receiving a portion of the shield plate 30 therein, as is best shown in FIG. 3.

Shield plate 30 includes: guide post receiving holes 33 for registering with guide posts 23 of header 20; boss receiving apertures 34 for receiving pin bosses 24 therein, the pin bosses include clips 34*a* for clipping engagement with clip engaging surfaces 24a of header 20; an offset section 35 formed in the shielded plate; shield tabs 38 for soldering to, for example, a printed circuit board; and formed ribs 39 which impart rigidity to the shield plate 30 once the shield plate 30 has been cut off of the carrier strip used during the formation of the shield plate 30.

Figure 7:
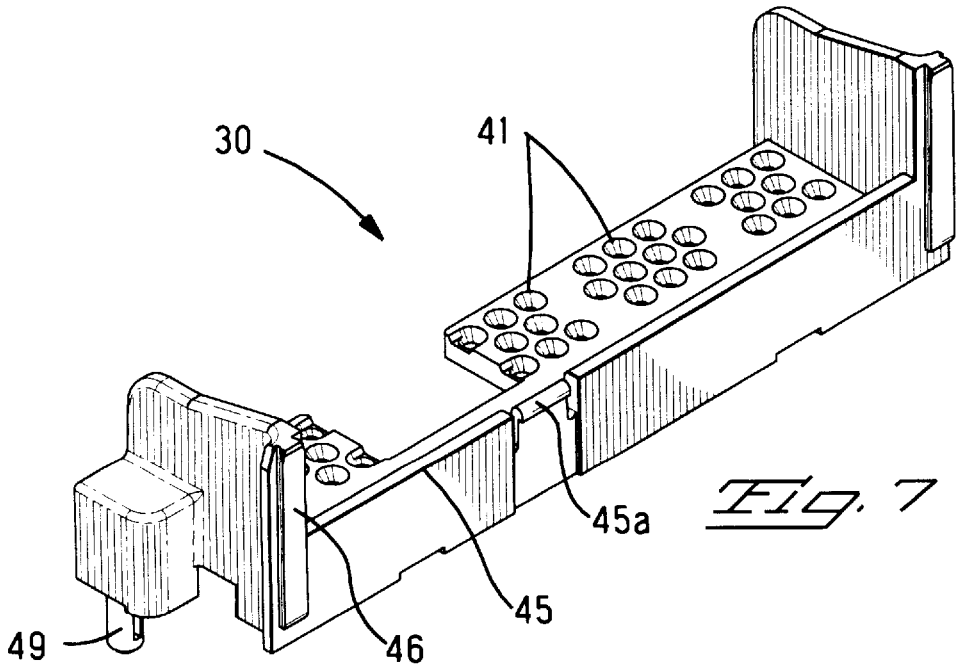
FIG. 7 is an isometric view of the pin guide according to the present invention.

Pin guide 40 includes: pin receiving apertures 41 for receiving pin contacts 21; a ledge 45 with a latch 45*a* formed therein, as is best shown in FIG. 7; dovetail formations 46 which are sized to be received in respective dovetailed recesses 26 of header 20; tab receiving slots 48 for receiving shield tabs 38 therein; and board lock structure 49 for mounting the connector assembly 10 to, for example, a printed circuit board. The board lock structure 49 is described in the present Assignee's United States patent application Ser. No. 08/437,339, which is hereby incorporated by reference in its entirety. Having the board lock structure 49 located on the pin guide member 40, rather than on the housing member 20, allows the board lock structure 49 to be located on the lighter of the two members, since the housing 20 is heavier than the pin guide 40. As such, the housing 20 may be permitted to simply drop out of an injection mold as part of the manufacturing process of the housing 20 since the risk of damage to the board lock structure 49, associated with the relatively heavy weight of the housing 20, is eliminated. Thus, a robotical pick-and-place arm is not needed in the process to remove the housing 20 from the mold.

Figure 2:
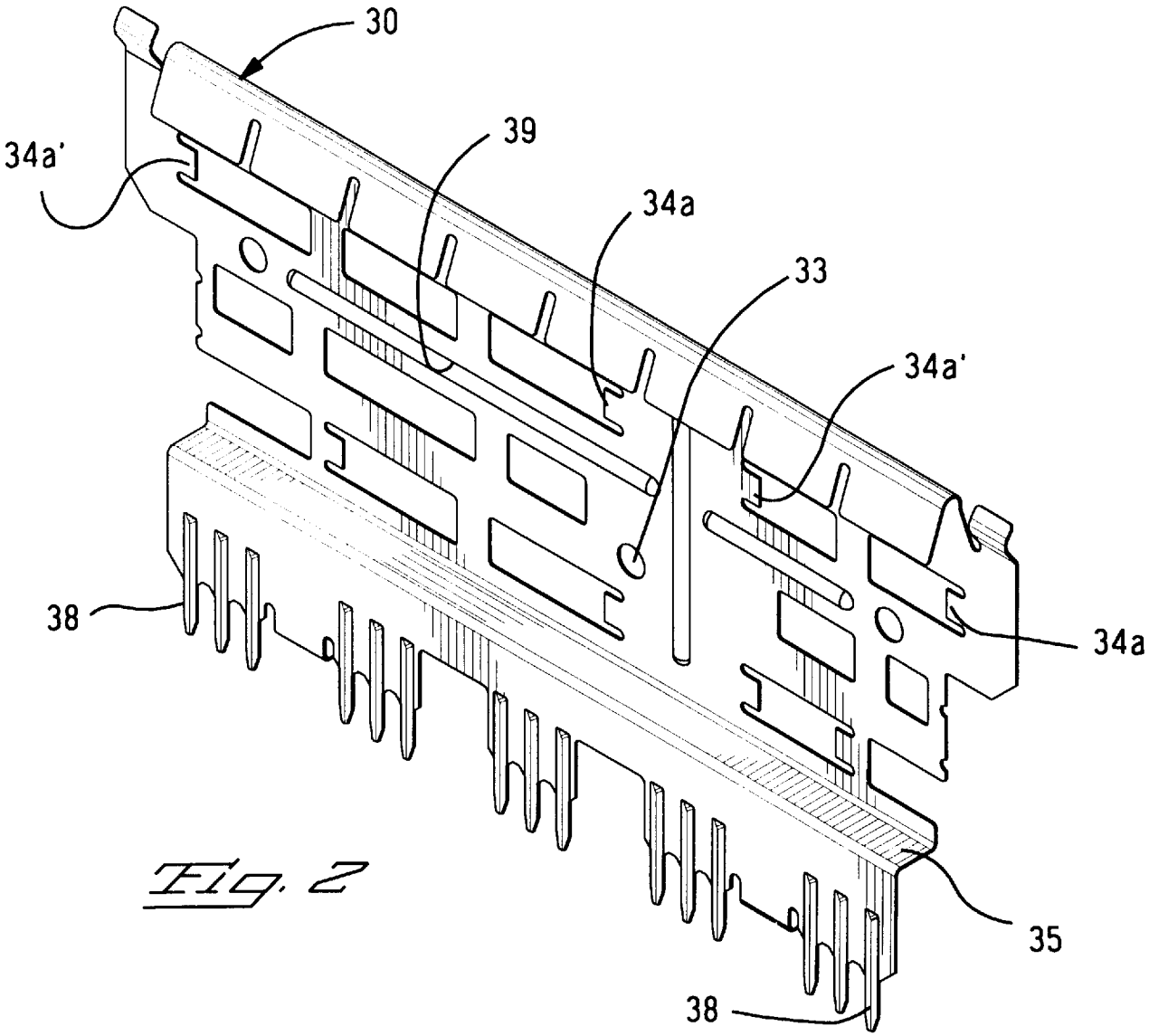
FIG. 2 is an isometric view of the shield of FIG. 1.

Shield plate 30, referring to FIG. 2, includes boss receiving apertures 34 having resilient clips 34*a*, 34*a*' for retaining the shield plate 30 onto the header 20 by engaging clip engaging surfaces 24*a*. The opposing orientation of clip 34*a* relative to clip 34*a*' presents a balanced retention arrangement. Shield tabs 38 are grouped in several clusters, which presents a plurality of least-resistance paths to ground for the electromagnetic energy absorbed by the shield, and thereby increases the shielding effectiveness of shield 30. Shield plate 30 is made of a suitable metallic material for the purpose of forming an isolation barrier around the circuit to prevent interaction of the circuit's electric and/or magnetic fields with those of nearby elements.

Now referring to FIGS. 3–4, assembly of the contact pins 21 into header 20 will be described. First, shield plate 30 is moved toward recess 22 of header 20 so that guide posts 23 register with respective post receiving holes 33, the plate 30 is then pressed towards header 20 and is mounted in recess 22. As this occurs, clips 34*a* of plate 30 engage respective clip engaging surfaces 24*a* of header 20, thereby retaining the plate 30 on header 20. Next, pin contacts 21 are stitched into respective contact receiving apertures 21*a* of pin bosses 24. The pins 21 project out and away from pin bosses 24 as shown in FIG. 4 prior to being bent. The pins are later bent in substantially a ninety-degree angle as shown in FIG. 5.

Figure 6:
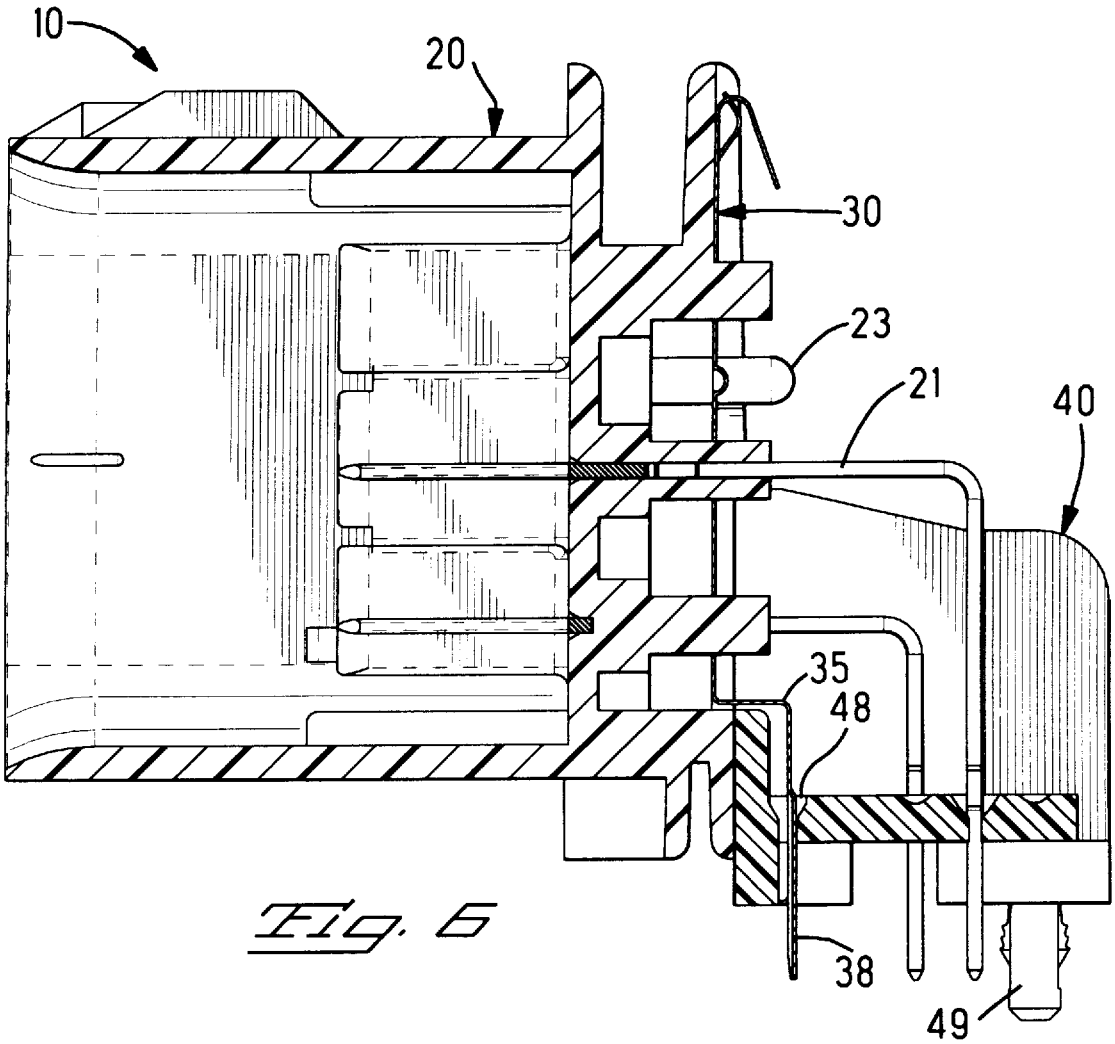
FIG. 6 is a cross sectional view of the electrical connector of FIG. 1 taken along line 6—6.

Assembly of the pin guide 40 to the header 20 and shield 30 will now be described. As shown in FIG. 5, board locks 49 are arranged for connection to pin guide 40, as described in United States application Ser. No. 08/437,339 previously incorporated by reference herein. Next, the pin guide 40 is aligned for mounting to header 20 so that: pin contacts 21 are aligned with corresponding pin receiving apertures 41; ledge 45 is aligned to be received by offset section 35; dovetail sections 46 are aligned to be slidingly received in respective dovetailed recesses 26; and tab receiving slots 48 are aligned to receive shield tabs 38 therethrough. At this point in the assembly process, the pin guide 40 is moved toward header 20 so that dovetailed sections 46 are slidingly received in respective dovetailed recesses 26, and the pin guide 40 is slid into position on header 20 as shown by the direction of arrow "A." Arrow A indicates the assembly motion of direction to assure that pin guide 40 is properly mounted to header 20. As this occurs, pins 21 will be inserted through pin receiving apertures 41, tabs 38 will be inserted through tab receiving slots 48, and ledge 45 will be disposed under offset section 35. Moreover, dovetailed sections 46 are snugly inserted into dovetailed recesses 26 by virtue of an interference type fit therebetween, thereby firmly retaining the pin guide 40 to the header 20, as is best shown in FIG. 6. Latch 45*a* of ledge 40 will engage a portion of connector 20 and thereby positively latch pin guide 40 on the header 20. Additionally, as dovetailed sections 46 are inserted into dovetailed recesses 26 the pin spacer 40 will be pulled toward the header 20 as interference between the dovetail sections 46 and recesses 26 increases as the pin guide 40 is moved toward header 20. Furthermore, assembly of the pin guide 30 to header 20 from the direction of arrow A advantageously results in a minimizing of tolerance stack-up, i.e. fewer dimensions are required to achieve the best dimensioning scheme.

Thus, while a preferred embodiment of the invention has been disclosed, it is to be understood that the invention is not to be strictly limited to such embodiment but may be otherwise variously embodied and practiced within the scope of the appended claims.

Accordingly, what is claimed is:

1. An electrical connector assembly comprising:

an electrical connector having at least one electrical contact therein, the electrical connector having front and rear sides wherein the rear side comprises an essentially planar surface;

a conductive shield mounted to the electrical connector, the shield comprises at least one shield solder tab;

a contact pin guide member mountable to the electrical connector having an associated assembly direction of motion relative to the electrical connector;

the pin guide comprises at least one contact receiving hole therethrough for guiding the electrical contact; and a shield solder tab receiving aperture for receiving the solder tab therethrough as the pin guide is mounted to the electrical connector.

2. The assembly of claim 1, wherein the pin guide comprises a board lock section.

3. The assembly of claim 1, wherein the electrical connector and the pin guide comprise complementary counting structure, and the mounting structure comprises at least one slot for receiving a respective mounting projection.

4. The assembly of claim 1, wherein the electrical connector and the pin guide comprise complementary counting structure for assembling the pin guide to the electrical connector, and the pin guide assembly direction of motion approaches the electrical connector from a bottom side thereof.

5. The assembly of claim 1, wherein the shield comprises clips for mounting the shield to the electrical connector.

* * * * *